US011373830B2

(12) United States Patent
Kawaguchi et al.

(10) Patent No.: US 11,373,830 B2
(45) Date of Patent: Jun. 28, 2022

(54) ELECTROMAGNETIC RELAY TO ENSURE STABLE ENERGIZATION EVEN WHEN CONTACT IS DISSOLVED

(71) Applicant: OMRON Corporation, Kyoto (JP)

(72) Inventors: Naoki Kawaguchi, Yame (JP); Ryota Minowa, Yamaga (JP); Hiroyuki Harimochi, Kumamoto (JP); Shinichi Ogawa, Kikuchi (JP); Kohei Otsuka, Omuta (JP); Hiroyuki Iwasaka, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/012,052

(22) Filed: Sep. 4, 2020

(65) Prior Publication Data

US 2021/0082650 A1 Mar. 18, 2021

(30) Foreign Application Priority Data

Sep. 13, 2019 (JP) ..... JP2019-167424

(51) Int. Cl.
*H01H 50/54* (2006.01)
*H01H 50/44* (2006.01)
*H01H 50/64* (2006.01)

(52) U.S. Cl.
CPC ..... *H01H 50/546* (2013.01); *H01H 50/44* (2013.01); *H01H 50/641* (2013.01)

(58) Field of Classification Search
CPC .... H01H 50/44; H01H 50/546; H01H 50/641; H01H 1/02; H01H 1/04
See application file for complete search history.

(56) References Cited

U.S. PATENT DOCUMENTS

| | | | | |
|---|---|---|---|---|
| 2007/0040637 | A1* | 2/2007 | Yee | H01H 59/0009 335/78 |
| 2007/0126538 | A1* | 6/2007 | Liu | H01H 50/32 335/172 |
| 2010/0123533 | A1* | 5/2010 | Helmreich | H01H 50/68 335/188 |
| 2011/0114602 | A1* | 5/2011 | Bush | H01H 1/64 218/156 |
| 2017/0069452 | A1 | 3/2017 | Hiroki et al. | |
| 2017/0133184 | A1* | 5/2017 | Fellmer | H01H 51/20 |
| 2018/0082814 | A1* | 3/2018 | Potter | H01H 9/542 |
| 2021/0166890 | A1* | 6/2021 | Belisle | H01H 50/541 |

FOREIGN PATENT DOCUMENTS

JP 2017-50274 A 3/2017

* cited by examiner

*Primary Examiner* — Bernard Rojas
(74) *Attorney, Agent, or Firm* — Shinjyu Global IP

(57) ABSTRACT

A movable contact piece is movable in an open direction and a closed direction with respect to a first fixed terminal and a second fixed terminal. A first movable contact is connected to the movable contact piece. The first movable contact is disposed facing a first fixed contact. A second movable contact is connected to the movable contact piece. The second movable contact is disposed facing a second fixed contact. At least one of the first fixed contact or the first movable contact has a material property different from that of at least one of the second fixed contact or the second movable contact.

14 Claims, 5 Drawing Sheets

ELECTROMAGNETIC RELAY TO ENSURE STABLE ENERGIZATION EVEN WHEN CONTACT IS DISSOLVED

CROSS-REFERENCE TO RELATED APPLICATION

This application claims priority to Japanese Patent Application No. 2019-167424, filed Sep. 13, 2019. The contents of that application are incorporated by reference herein in their entirety.

FIELD

The present invention relates to an electromagnetic relay.

BACKGROUND

For example, an electromagnetic relay includes a movable contact piece, a movable contact, a fixed contact, and a fixed terminal as described in Japanese Patent Laid-Open No. 2017-50274. The movable contact is connected to the movable contact piece. The movable contact piece moves between an open position and to a closed position. When the movable contact piece is at the open position, the movable contact is separated from the fixed contact. When the movable contact piece is at the closed position, the movable contact comes into contact with the fixed contact. As a result, the fixed terminal and the movable contact piece are energized.

SUMMARY

When an overcurrent flows through the electromagnetic relay, a contact may be dissolved. When the contact is dissolved, a gap is formed between the fixed terminal and the movable contact piece. This makes it difficult to stably energize the fixed terminal and the movable contact piece. An object of the present disclosure is to ensure stable energization in an electromagnetic relay even when a contact is dissolved.

An electromagnetic relay according to one aspect includes a first fixed terminal, a first fixed contact, a second fixed terminal, a second fixed contact, a movable contact piece, a first movable contact, and a second movable contact. The first fixed contact is connected to the first fixed terminal. The second fixed contact is connected to the second fixed terminal. The movable contact piece is movable in an open direction and a closed direction with respect to the first fixed terminal and the second fixed terminal. The first movable contact is connected to the movable contact piece. The first movable contact is disposed facing the first fixed contact. The second movable contact is connected to the movable contact piece. The second movable contact is disposed facing the second fixed contact. At least one of the first fixed contact and the first movable contact has a material property different from that of at least one of the second fixed contact and the second movable contact.

With the electromagnetic relay according to the present aspect, a timing at which at least one of the first fixed contact and the first movable contact is dissolved and a timing at which at least one of the second fixed contact and the second movable contact is dissolved can be made different from each other, even when an overcurrent flows. As a result, stable energization can be ensured even when a contact is dissolved.

At least one of the first fixed contact and the first movable contact may have a melting point different from that of at least one of the second fixed contact and the second movable contact. In this case, a timing at which at least one of the first fixed contact and the first movable contact is dissolved and a timing at which at least one of the second fixed contact and the second movable contact can be made different from each other due to the difference in melting point.

At least one of the first fixed contact and the first movable contact may have an electric resistance different from that of at least one of the second fixed contact and the second movable contact. In this case, a timing at which at least one of the first fixed contact and the first movable contact is dissolved and a timing at which at least one of the second fixed contact and the second movable contact is dissolved can be made different from each other due to the difference in electrical resistance.

At least one of the first fixed contact and the first movable contact may include a conductive material different from that of at least one of the second fixed contact and the second movable contact. In this case, a timing at which at least one of the first fixed contact and the first movable contact is dissolved and a timing at which at least one of the second fixed contact and the second movable contact is dissolved can be made different from each other due to the difference in conductive material.

The first fixed contact may be made from a first material. The second fixed contact may be made from a second material different from the first material. In this case, a timing at which the first fixed contact and the first movable contact is dissolved and a timing at which the second fixed contact and the second movable contact is dissolved can be made different from each other.

The first movable contact may be made from a first material. The second movable contact may be made from a second material different from the first material. In this case, a timing at which the first movable contact is dissolved and a timing at which the second movable contact is dissolved can be made different from each other.

The electromagnetic relay may further include a movable mechanism and a drive device. The movable mechanism may support the movable contact piece such that the movable contact piece is movable in the open direction and the closed direction. The drive device may move the movable mechanism. The drive mechanism may include a coil, a fixed iron core, and a movable iron core. The fixed iron core may be disposed in the coil. The movable iron core may be facing the fixed iron core and be connected to the movable mechanism. The first movable contact may come into contact with the first fixed contact and the second movable contact may come into contact with the second fixed contact in a state where the movable iron core is in contact with the fixed iron core.

A contact follow of the movable contact piece may be less than a sum of the lengths of the first fixed contact and the first movable contact in the moving direction of the movable contact piece and/or a sum of the lengths of the second fixed contact and the second movable contact in the moving direction of the movable contact piece. In this case, the contact follow enables to improve a contact pressure of the contacts. In the case where the contact follow and the contact dimension are in the above relationship, a gap is likely to be formed between the first and second fixed terminals and the movable contact piece when all the contacts are dissolved at the same time. However, in the electromagnetic relay according to the present aspect, the timing at which at least one of the first fixed contact and the first movable contact is dissolved and the timing at which at least one of the second fixed contact and the second movable contact is dissolved can be made different from each other, even when an overcurrent flows. As a result, stable energization can be ensured even when a contact is dissolved.

DETAILED DESCRIPTION

Figure 1:
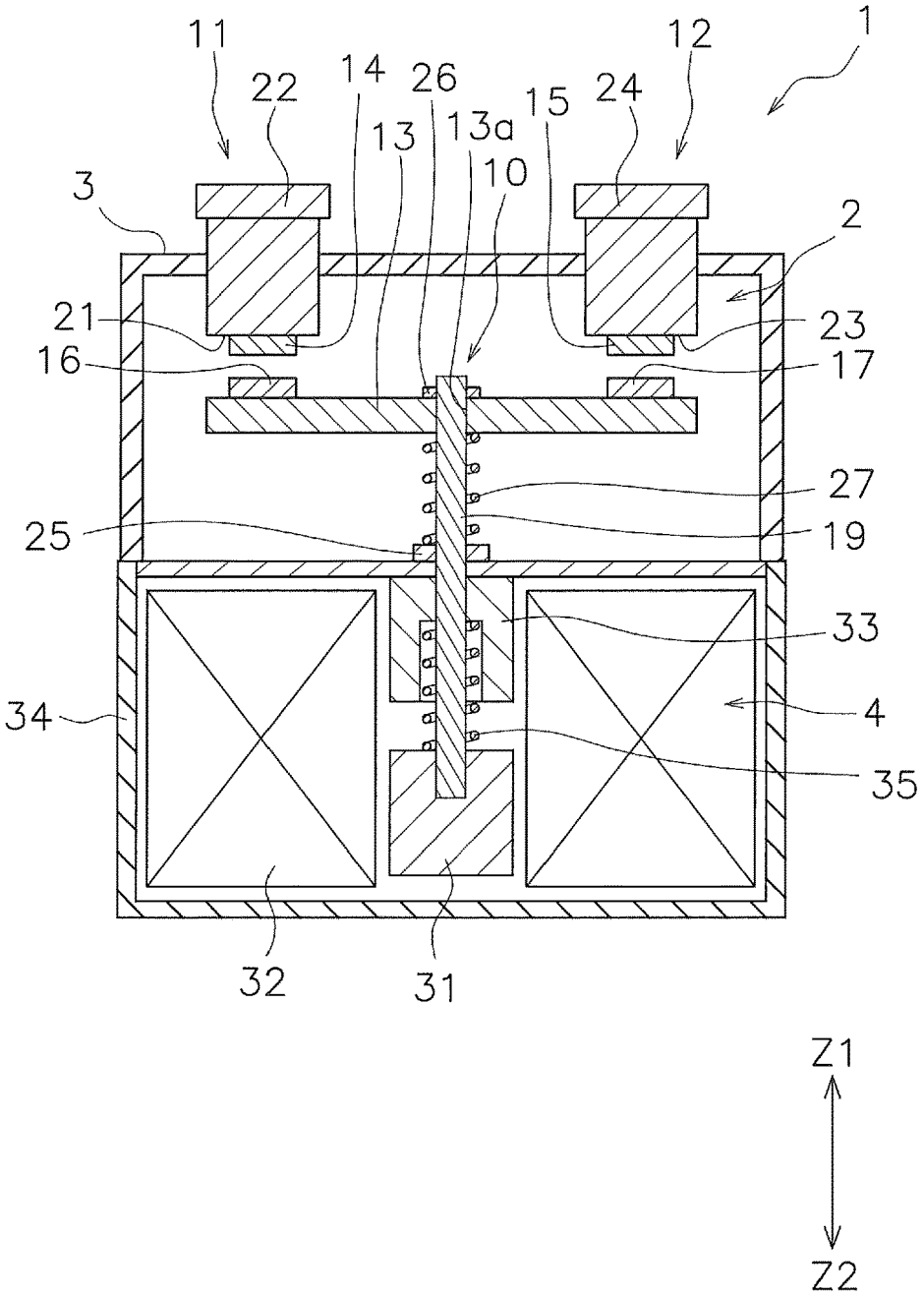
FIG. 1 is a side cross-sectional view illustrating an electromagnetic relay in an opened state according to an embodiment.

An electromagnetic relay 1 according to an embodiment will be explained below with reference to the drawings. FIG. 1 is a side cross-sectional view illustrating the electromagnetic relay 1 according to the embodiment. As illustrated in FIG. 1, the electromagnetic relay 1 includes a contact device 2, a housing 3, and a drive device 4.

In the following description, the up, down, left, and right directions indicate the up, down, left, and right directions in FIG. 1. Specifically, the direction from the drive device 4 toward the contact device 2 is defined as up(ward). The direction from the contact device 2 toward the drive device 4 is defined as down(ward). In FIG. 1, a direction that crosses an up-down direction is defined as a left-right direction. A direction that crosses the up-down direction and the left-right direction is defined as a front-back direction. The front-back direction is a direction perpendicular to the sheet of FIG. 1. However, these directions are defined for convenience of description and are not intended to limit the directions in which the electromagnetic relay 1 is disposed.

The contact device 2 is disposed in the housing 3. The contact device 2 includes a movable mechanism 10, a first fixed terminal 11, a second fixed terminal 12, a movable contact piece 13, a first fixed contact 14, a second fixed contact 15, a first movable contact 16, and a second movable contact 17. The first fixed terminal 11 and the second fixed terminal 12 are made from a conductive material such as copper or copper alloy. The first fixed contact 14 is connected to the first fixed terminal 11. The second fixed contact 15 is connected to the second fixed terminal 12. The first fixed contact 14 and the second fixed contact 15 are disposed separated in the left-right direction.

The first fixed terminal 11 includes a first contact support portion 21 and a first external terminal portion 22. The first contact support portion 21 faces the movable contact piece 13. The first fixed contact 14 is connected to the first contact support portion 21. The first external terminal portion 22 is connected to the first contact support portion 21. The first external terminal portion 22 protrudes outward from the housing 3.

The second fixed terminal 12 includes a second contact support portion 23 and a second external terminal portion 24. The second contact support portion 23 faces the movable contact piece 13. The second fixed contact 15 is connected to the second contact support portion 23. The second external terminal portion 24 is connected to the second contact support portion 23. The second external terminal portion 24 protrudes outward from the housing 3. Specifically, the first external terminal portion 22 and the second external terminal portion 24 protrude upward from the housing 3.

The movable contact piece 13 is made from a conductive material such as copper or copper alloy. The movable contact piece 13 extends in the left-right direction. The movable contact piece 13 is disposed facing the first contact support portion 21 of the first fixed terminal 11 and the second contact support portion 23 of the second fixed terminal 12 in the up-down direction.

The movable contact piece 13 is disposed so as to be movable in a closed direction Z1 and an open direction Z2. The closed direction Z1 is a direction in which the movable contact piece 13 approaches the first fixed terminal 11 and the second fixed terminal 12 (upward in FIG. 1). The open direction Z2 is a direction in which the movable contact piece 13 separates from the first fixed terminal 11 and the second fixed terminal 12 (downward in FIG. 1).

The first movable contact 16 and the second movable contact 17 are connected to the movable contact piece 13. The first movable contact 16 and the second movable contact 17 are disposed separated in the left-right direction. The first movable contact 16 faces the first fixed contact 14 in the up-down direction. The second movable contact 17 faces the second fixed contact 15 in the up-down direction.

The movable mechanism 10 supports the movable contact piece 13. The movable mechanism 10 is disposed so as to be movable in the closed direction Z1 and the open direction Z2 together with the movable contact piece 13. The movable mechanism 10 includes a drive shaft 19, a first holding member 25, a second holding member 26, and a contact spring 27. The drive shaft 19 extends in the up-down direction. The drive shaft 19 is connected to the movable contact piece 13. The drive shaft 19 extends downward from the movable contact piece 13. The movable contact piece 13 includes a hole 13*a*. The drive shaft 19 is inserted into the hole 13*a*. The movable contact piece 13 is relatively movable with respect to the drive shaft 19 in the closed direction Z1 and the open direction Z2.

Figure 2:
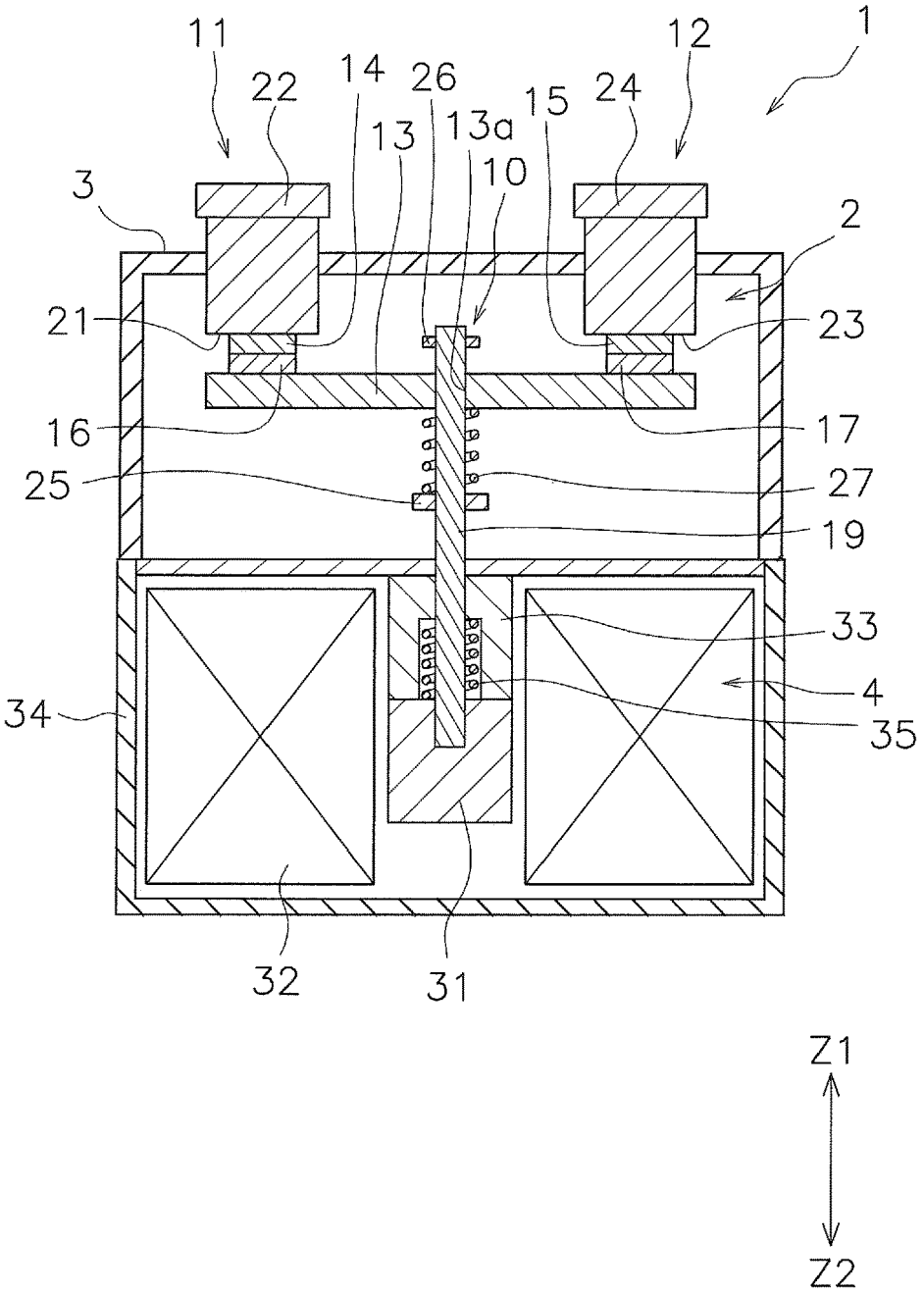
FIG. 2 is a side cross-sectional view illustrating the electromagnetic relay in a closed state.

The drive shaft 19 is configured to move between a closed position and an open position. FIG. 1 illustrates the drive shaft 19 at the open position. As illustrated in FIG. 1, the movable contacts 16 and 17 are separated from the fixed contacts 14 and 15 when the drive shaft 19 is at the open position. FIG. 2 illustrates the drive shaft 19 at the closed position. As illustrated in FIG. 2, the movable contacts 16 and 17 are in contact with the fixed contacts 14 and 15 when the drive shaft 19 is at the closed position.

The first holding member 25 is fixed to the drive shaft 19. The contact spring 27 is disposed between the movable contact piece 13 and the first holding member 25. The contact spring 27 urges the movable contact piece 13 in the closed direction Z1 in a state where the movable contacts 16 and 17 are in contact with the fixed contacts 14 and 15. The second holding member 26 is fixed to the drive shaft 19. The movable contact piece 13 is located between the second holding member 26 and the contact spring 27.

The drive device 4 operates the movable contact piece 13 by electromagnetic force. The drive device 4 moves the movable mechanism 10 in the closed direction Z1 and the open direction Z2. As a result, the drive device 4 moves the movable contact piece 13 in the closed direction Z1 and the open direction Z2. The drive device 4 includes a movable iron core 31, a coil 32, a fixed iron core 33, a yoke 34, and a return spring 35.

The movable iron core 31 is connected to the drive shaft 19. The movable iron core 31 is configured to move in the closed direction Z1 and the open direction Z2. The coil 32 is energized to generate electromagnetic force that moves the movable iron core 31 in the closed direction Z1. The fixed iron core 33 is disposed facing the movable iron core 31. The return spring 35 is disposed between the movable iron core 31 and the fixed iron core 33. The return spring 35 urges the movable iron core 31 in the open direction Z2.

The yoke 34 is disposed surrounding the coil 32. The yoke 34 is disposed on a magnetic circuit formed by the coil 32. Portions of the yoke 34 are disposed above, below, and to sides of the coil 32.

Next, operation of the electromagnetic relay 1 will be described. When the coil 32 is not energized, the drive device 4 is not magnetized. In this case, the drive shaft 19 is pressed in the open direction Z2 by the elastic force of the return spring 35 together with the movable iron core 31. Therefore, the drive shaft 19 is located at the open position illustrated in FIG. 1. In this state, the movable contact piece 13 is also pressed in the open direction Z2 via the movable mechanism 10. Therefore, when the drive shaft 19 is at the open position, the first movable contact 16 and the second movable contact 17 separate from the first fixed contact 14 and the second fixed contact 15, respectively.

When the coil 32 is energized, the drive device 4 is magnetized. In this case, the electromagnetic force of the coil 32 causes the movable iron core 31 to move in the closed direction Z1 against the elastic force of the return spring 35. As a result, the drive shaft 19 and the movable contact piece 13 move together in the closed direction Z1. Thus, as illustrated in FIG. 2, the drive shaft 19 moves to the closed position. As a result, when the drive shaft 19 is at the closed position, the first movable contact 16 and the second movable contact 17 come into contact with the first fixed contact 14 and the second fixed contact 15, respectively.

Figure 3:
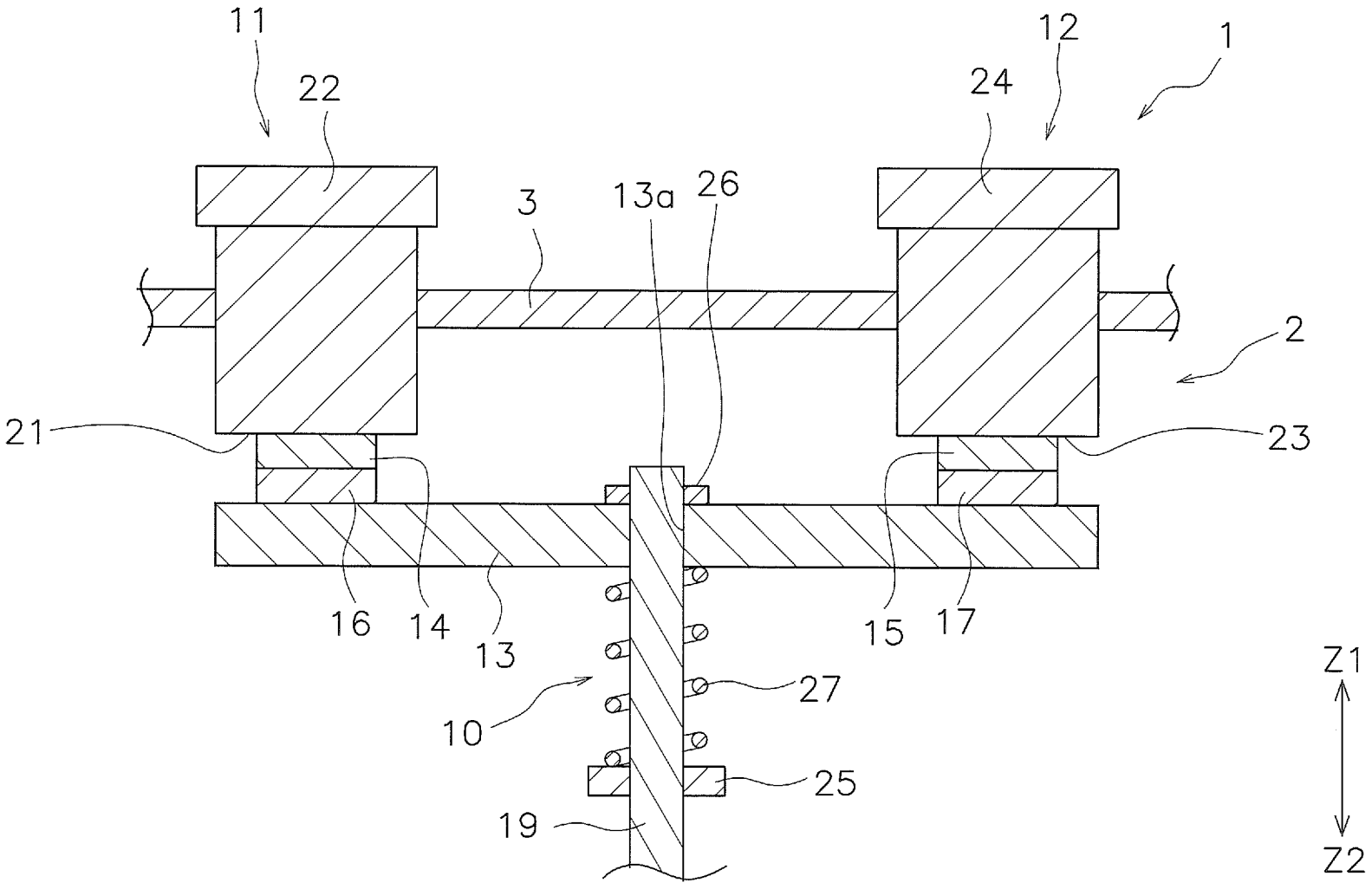
FIG. 3 is an enlarged view of a contact device when a movable contact starts contacting a fixed contact.
Figure 4:
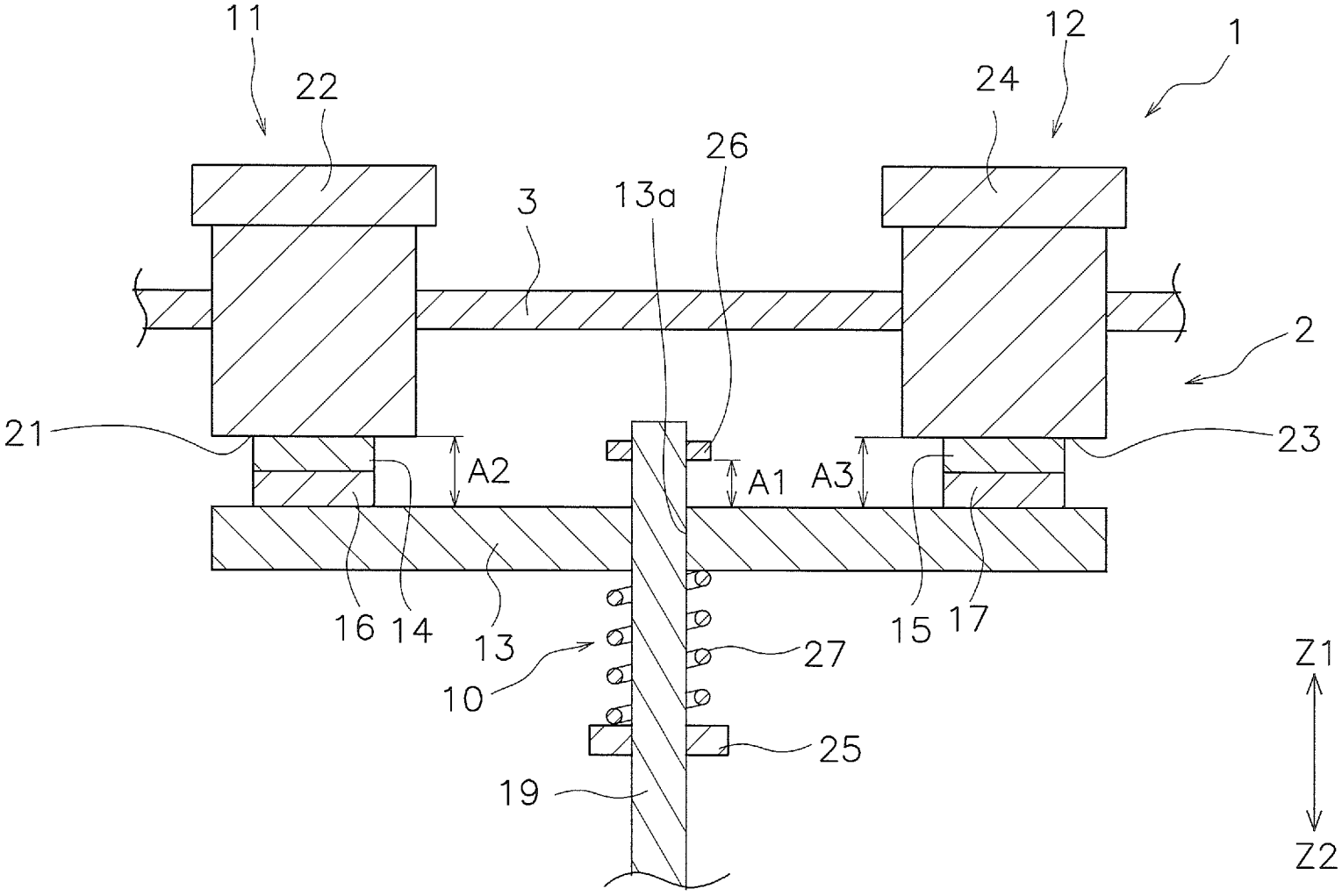
FIG. 4 is an enlarged view of the contact device in which a movable mechanism is at a closed position.

Specifically, when the drive shaft 19 moves from the open position to the closed position, as illustrated in FIG. 3, the first movable contact 16 and the second movable contact 17 come into contact with the first fixed contact 14 and the second fixed contact 15, respectively, before the drive shaft 19 reaches the closed position. This restricts the movement of the movable contact piece 13 in the closed direction Z1. In this state, the movable iron core 31 is not in contact with the fixed iron core 33 and is separated from the fixed iron core 33. Thus, the movable iron core 31 can further moves in the closed direction Z1. Therefore, as illustrated in FIG. 4, when the drive shaft 19 further moves in the closed direction Z1, the drive shaft 19 moves in the closed direction Z1 with respect to the movable contact piece 13. As a result, the distance between the first holding member 25 and the movable contact piece 13 decreases, causing the contact spring 27 to be compressed. Therefore, when the drive shaft 19 is at the closed position, the contact spring 27 urges the movable contact piece 13 in the closed direction Z1. As illustrated in FIG. 2, when the drive shaft 19 is at the closed position, the movable iron core 31 comes into contact with the fixed iron core 33. As a result, the movement of the drive shaft 19 in the closed direction Z1 is restricted.

In FIG. 4, "A1" indicates a contact follow. The contact follow A1 is the distance between a contact start position and the closed position. The contact start position is a position of the drive shaft 19 when the first movable contact 16 and the second movable contact 17 first come into contact with the first fixed contact 14 and the second fixed contact 15.

The contact follow A1 of the movable contact piece 13 is less than a sum A2 of the lengths of the first fixed contact 14 and the first movable contact 16 in the moving direction of the movable contact piece 13. The contact follow A1 of the movable contact piece 13 is less than a sum A3 of the lengths of the second fixed contact 15 and the second movable contact 17 in the moving direction of the movable contact piece 13.

When the current to the coil 32 is stopped and the coil 32 is demagnetized, the movable iron core 31 is pressed in the open direction Z2 by the elastic force of the return spring 35. As a result, the drive shaft 19 and the movable contact piece 13 move together in the open direction Z2. Therefore, as illustrated in FIG. 1, the movable mechanism 10 moves to the open position. As a result, when the movable mechanism 10 is at the open position, the first movable contact 16 and the second movable contact 17 separate from the first fixed contact 14 and the second fixed contact 15, respectively.

In the electromagnetic relay 1 according to the present embodiment, the first fixed contact 14 and the first movable contact 16 are made from a first material. The second fixed contact 15 and the second movable contact 17 are made from a second material. The first material has a material property different from that of the second material. Specifically, the first material is a conductive material different from the second material. Therefore, the first fixed contact 14 and the first movable contact 16 have a melting point different from that of the second fixed contact 15 and the second movable contact 17.

The first material and the second material may be selected from materials known as a contact material. For example, the first material is a conductive material such as silver, silver alloy, copper alloy, or tungsten alloy. The second material is a conductive material such as silver, a silver alloy, a copper alloy, or a tungsten alloy that is different from the first material.

In the electromagnetic relay 1 according to the present embodiment described above, the first fixed contact 14 and the first movable contact 16 have a material property different from that of the second fixed contact 15 and the second movable contact 17. Therefore, even when an overcurrent flows, a timing at which the first fixed contact 14 and the first movable contact 16 are dissolved and a timing at which the second fixed contact 15 and the second movable contact 17 are dissolved can be made different from each other. As a result, even when a contact is dissolved, it is possible to prevent a gap from being generated between the fixed terminals 11 and 12 and the movable contact piece 13. Thereby, stable energization can be ensured between the fixed terminals 11 and 12 and the movable contact piece 13.

In the electromagnetic relay 1 according to the present embodiment, the contact follow A1 of the movable contact piece 13 is less than the sum A2 of the lengths of the fixed contacts 14 and 15 and the sum A3 of the movable contacts 16 and 17, respectively. Therefore, when the fixed contacts 14 and 15 and the movable contacts 16 and 17 are all dissolved, a gap is generated between the fixed terminals 11 and 12 and the movable contact piece 13. However, in the electromagnetic relay according to the present embodiment, a timing at which the first fixed contact 14 and the first movable contact 16 are dissolved and a timing at which the second fixed contact 15 and the second movable contact 17 are dissolved can be made different from each other, even when an overcurrent flows. Thereby, stable energization can be ensured between the fixed terminals 11 and 12 and the movable contact piece 13.

Although an embodiment of the present invention has been described so far, the present invention is not limited to the above embodiment and various modifications may be made within the scope of the invention.

The first fixed contact 14 and the second fixed contact 15 may be made from the same material. The first movable contact 16 and the second movable contact 17 may be made from the same material. The first fixed contact 14 and the second fixed contact 15 may be made from a material different from that of the first movable contact 16 and the second movable contact 17.

In the above embodiment, the different material property is the melting point. However, the different material property may be another property such as electrical resistance. A different material property may be achieved by different types of surface treatment or using different materials for surface treatment. Alternatively, a different material property may be achieved with or without applying a surface treatment. The surface treatment may be plating, cladding, or the like.

In the embodiment described above, the drive device 4 push out the drive shaft 19 from the drive device 4 side such that the movable contact piece 13 moves in the closed direction Z1. Further, the drive device 4 pulls the drive shaft 19 to the drive device 4 side such that the movable contact piece 13 moves in the open direction Z2. However, the operation direction of the drive shaft 19 for opening and closing the contacts may be opposite to that in the embodiment described above. That is, the drive device 4 may pull the drive shaft 19 toward the drive device 4 side such that the movable contact piece 13 moves in the closed direction Z1. The drive device 4 may push out the drive shaft 19 from the drive device 4 side such that the movable contact piece 13 moves in the open direction Z2. That is, the closed direction Z1 and the open direction Z2 may be opposite to those in the above embodiment.

Figure 5:
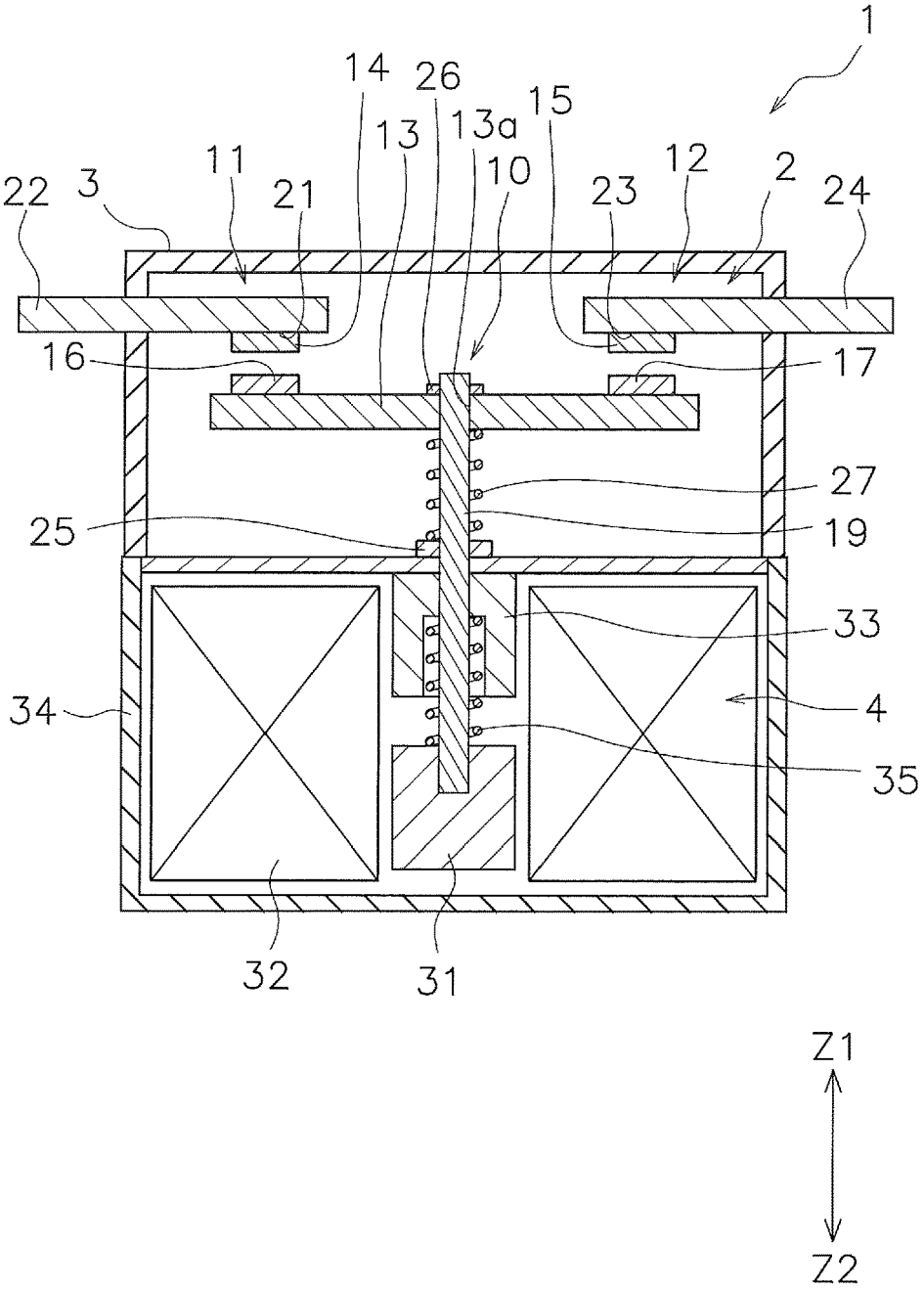
FIG. 5 is a side cross-sectional view illustrating the electromagnetic relay according to a modified example.

The shape or disposition of the first fixed terminal 11, the second fixed terminal 12, or the movable contact piece 13 may be changed. For example, as illustrated in FIG. 5, the first external terminal portion 22 and the second external terminal portion 24 may protrude from the housing 3 in the left-right direction. Alternatively, the first external terminal portion 22 and the second external terminal portion 24 may protrude from the housing 3 in the front-back direction. The shape or disposition of the movable iron core 31, the coil 32, the fixed iron core 33, or the yoke 34 may be changed. The shape or disposition of the first fixed contact 14, the second fixed contact 15, the first movable contact 16, or the second movable contact 17 may be changed.

The first fixed contact 14 may be separated from or integrated with the first fixed terminal 11. The second fixed contact 15 may be separated from or integrated with the second fixed terminal 12. The first movable contact 16 may be separated from or integrated with the movable contact piece 13. The second movable contact 17 may be separated from or integrated with the movable contact piece 13.

The contact follow A1 of the movable contact piece 13 may be equal to or greater than the sum A2 of the lengths of the first fixed contact 14 and the first movable contact 16 in the moving direction of the movable contact piece 13. The contact follow A1 of the movable contact piece 13 may be equal to or greater than the sum A3 of the lengths of the second fixed contact 15 and the second movable contact 17 in the moving direction of the movable contact piece 13. Alternatively, the contact follow A1 of the movable contact piece 13 may be omitted.

REFERENCE NUMERALS

4: Drive device, 12: Second fixed terminal, 10: Movable mechanism, 11: First fixed terminal, 13: Movable contact piece, 14: First fixed contact, 15: Second fixed contact, 16: First movable contact, 17: Second movable contact, 31: Movable iron core, 32: Coil, 33: Fixed iron core

The invention claimed is:

1. An electromagnetic relay comprising:

a first fixed terminal;

a first fixed contact connected to the first fixed terminal;

a second fixed terminal;

a second fixed contact connected to the second fixed terminal;

a movable contact piece configured to move in a moving direction including an open direction and a closed direction with respect to the first fixed terminal and the second fixed terminal;

a first movable contact connected to the movable contact piece and disposed facing the first fixed contact; and a second movable contact connected to the movable contact piece and disposed facing the second fixed contact, wherein the first fixed contact is located at a same height as the second fixed contact, the first fixed contact has a material property different from that of the second fixed contact, the movable contact piece is configured to move from a contact start position to a closed position in the closed direction, the contact start position is a position where the first movable contact and the second movable contact start to come into contact with the first fixed contact and the second fixed contact respectively, a distance between the contact start position and the closed position is defined as a contact follow, and the contact follow is less than a sum of lengths of the first fixed contact and the first movable contact in the moving direction of the movable contact piece and/or a sum of lengths of the second fixed contact and the second movable contact in the moving direction of the movable contact piece.

2. The electromagnetic relay according to claim 1, wherein the first fixed contact has a melting point different from that of the second fixed contact.

3. The electromagnetic relay according to claim 1, wherein the first fixed contact has an electric resistance different from that of the second fixed contact.

4. The electromagnetic relay according to claim 1, wherein the first fixed contact includes a conductive material different from that of the second fixed contact.

5. The electromagnetic relay according to claim 1, wherein the first fixed contact is made from a first material, and the second fixed contact is made from a second material different from the first material.

6. The electromagnetic relay according to claim 1 further comprising:

a movable mechanism configured to support the movable contact piece such that the movable contact piece is movable in the open direction and the closed direction; and a drive device configured to move the movable mechanism, wherein the drive device includes a coil, a fixed iron core disposed in the coil, and a movable iron core facing the fixed iron core and connected to the movable mechanism.

7. The electromagnetic relay according to claim 6, wherein the first movable contact is configured to contact the first fixed contact and the second movable contact is configured to contact the second fixed contact in a state where the movable iron core contacts the fixed iron core.

8. An electromagnetic relay comprising:

a first fixed terminal;

a first fixed contact connected to the first fixed terminal;

a second fixed terminal;

a second fixed contact connected to the second fixed terminal;

a movable contact piece configured to move in a moving direction including an open direction and a closed direction with respect to the first fixed terminal and the second fixed terminal;

a first movable contact connected to the movable contact piece and disposed facing the first fixed contact; and a second movable contact connected to the movable contact piece and disposed facing the second fixed contact, wherein the first movable contact is located at a same height as the second movable contact, the first movable contact has a material property different from that of the second movable contact, the movable contact piece is configured to move from a contact start position to a closed position in the closed direction, the contact start position is a position where the first movable contact and the second movable contact start to come into contact with the first fixed contact and the second fixed contact respectively, a distance between the contact start position and the closed position is defined as a contact follow, and the contact follow is less than a sum of lengths of the first fixed contact and the first movable contact in the moving direction of the movable contact piece and/or a sum of lengths of the second fixed contact and the second movable contact in the moving direction of the movable contact piece.

9. The electromagnetic relay according to claim 8, wherein the first movable contact has a melting point different from that of the second movable contact.

10. The electromagnetic relay according to claim 8, wherein the first movable contact has an electric resistance different from that of the second movable contact.

11. The electromagnetic relay according to claim 8, wherein the first movable contact includes a conductive material different from that of the second movable contact.

12. The electromagnetic relay according to claim 8, wherein the first movable contact is made from a first material, and the second movable contact is made from a second material different from the first material.

13. The electromagnetic relay according to claim 8 further comprising:

a movable mechanism configured to support the movable contact piece such that the movable contact piece is movable in the open direction and the closed direction; and a drive device configured to move the movable mechanism, wherein the drive device includes a coil, a fixed iron core disposed in the coil, and a movable iron core facing the fixed iron core and connected to the movable mechanism.

14. The electromagnetic relay according to claim 13, wherein the first movable contact is configured to contact the first fixed contact and the second movable contact is configured to contact the second fixed contact in a state where the movable iron core contacts the fixed iron core.

* * * * *